US006458166B1

(12) United States Patent
Fleissner

(10) Patent No.: US 6,458,166 B1
(45) Date of Patent: Oct. 1, 2002

(54) METHOD AND DEVICE FOR FIXING OF TUBULAR FABRIC

(75) Inventor: Gerold Fleissner, Zug (CH)

(73) Assignee: Fleisner GmbH & Co., Maschinenfabrik, Egelsbach (DE)

( * ) Notice: Subject to any disclaimer, the term of this patent is extended or adjusted under 35 U.S.C. 154(b) by 0 days.

(21) Appl. No.: 09/552,584

(22) Filed: Apr. 19, 2000

(51) Int. Cl.[7] ..... D06B 3/10; D06B 23/00
(52) U.S. Cl. ..... 8/149.3; 68/5 D
(58) Field of Search ..... 8/149.2, 149.3; 68/5 D, 5 E; 26/81

(56) References Cited

U.S. PATENT DOCUMENTS 3,868,215 A * 2/1975 Frezza ..... 65/5 E X
4,112,532 A * 9/1978 Catallo ..... 68/5 D X

FOREIGN PATENT DOCUMENTS

DE 1635348 * 4/1971
DE 1635363 * 3/1972
DE 2829008 * 3/1979

* cited by examiner

*Primary Examiner*—Philip Coe
(74) *Attorney, Agent, or Firm*—Antonelli, Terry, Stout & Kraus, LLP

(57) ABSTRACT

The use of saturated steam for the steaming of tubular fabric is known. However, this does not produce permanent fixing of the fibers. This only takes place at considerably higher temperatures, where the fibers are damaged, however. If the treatment is carried out rapidly, such as on a rotary screen and using a steam-air mixture, it is possible to carry out advantageous fixing also for elastic fibers at temperatures of e.g. 210° C. without damage. It is advantageous, if the tubular fabric is spread out at ambient temperature and treated in this spread-out state on the rotary screen.

8 Claims, 1 Drawing Sheet

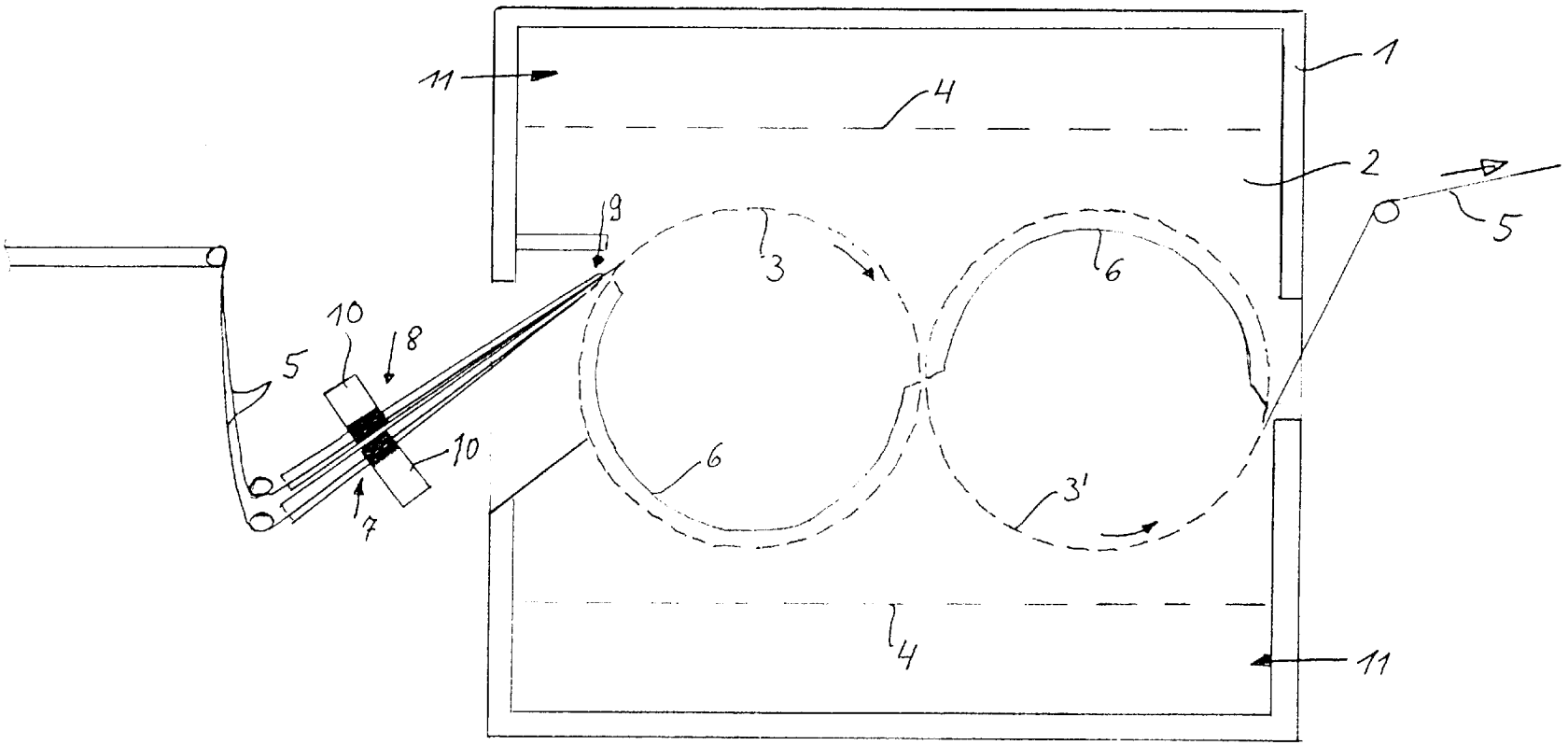
1
2
5
11
6
3'
4
4
3
6
9
11
10
8
10
7
5

METHOD AND DEVICE FOR FIXING OF TUBULAR FABRIC

BACKGROUND OF THE INVENTION

The invention relates to a method for fixing such as the width fixing of tubular fabric by deliberate spreading out of the tubular fabric and subsequent steaming.

A method of this kind is known from DE-A-28 29 008. By steaming the tube, it is stabilized in the spread out state produced by the spreader. The steaming is performed with saturated steam at approximately 100° C. After steaming, the tube is driven through a calender, so as to achieve a final stabilization in the spread out state. Permanent marking of the edges cannot be avoided as the result of calendering.

DE-A-16 35 348 also discloses that knitted tubular fabric is moved across several sequentially arranged spreaders throughout the duration of the steaming process, during which time the saturated steam is blown alternately through the inflated tube from the inside to the outside and then transversely therethrough. Aside from this very elaborate and costly treatment, it ultimately does not guarantee the absence of rejects due to the marking of edges, since the treatment is carried out across spreaders throughout its entire course. The spreaders and the other equipment components described in the above patent, which have become hot as a result of the treatment, produce irreversible markings during the course of the treatment. The same patent specification also proposes to use only one of the spreaders to inflate the tube, from which the spread out and pre-steamed fabric is initially laid onto an endless belt, which then transports the fabric into a rotary screen unit which merely dries it. This method, however, simply because of the intermediate endless belt step, does not guarantee a fabric that is fixed to the required width.

DE-A-16 35 363 merely discloses a short, vertically aligned spreader, in whose heating chamber any required temperature and any required atmospheric condition can be generated. It thus is not possible to fix a required web width together with fixing the fiber that is used in each case. Here too, the fabric is spread out with spreader elements throughout the entire treatment, which also results in permanent markings depending on the temperature used.

The tricot manufacturing industry increasingly employs elastic fibers, such as Elasthan (e.g. Lycra), in order to achieve higher elasticity of knitted fabrics. The use of Lycra, however, has the disadvantage of increasing the tendency of the fabric web edges of the cut-open tube to curl up, as is the case with cotton, for example. In addition, the Elasthan fiber pulls back from the cut edge while the tube is cut open and also during the making of the cutting edge, making the fabric unusable in the vicinity of the cut edge. Presently, the need for fixing such tubular fabric is even greater.

Fixing of the dry fabric is carried out in a dryer at elevated temperature. However, the temperature must not be too high so as to prevent damage to cotton and Elasthan fibers. Thus, the normal fixing temperatures from 185–210° C. cannot be used, since cotton becomes brittle and hard, and the Elasthan fiber even melts. The fabric then acquires a hard and rough feel. However, lower temperatures result in a deterioration of the permanent fixing effect.

SUMMARY OF THE INVENTION

The object of the invention is to find a method together with a suitable device to produce a satisfactory fixing of e.g. tubular cotton fabrics with Elasthan fibers.

Starting out from the known method of the type previously mentioned, the invention has the task of solving the problem by treating a knitted tube that is made from e.g. cotton and all types of elastic fibers such as Elasthan or Lycra, which has preferably been spread out without the marking of edges at ambient temperature, which is then heat treated at a temperature of 110–250° C. immediately after removal from the spreader, where the gas used for the treatment is a steam-air mixture. The fixing temperature should preferably be 210° C.

In spite of this elevated temperature during heat treatment, no fiber damage was noticeable. The steam acts as a fiber protection for the cotton as well as for the Elasthan fiber. The fabric is fixed to the required width and has a silk-like feel after the fixing process. The fabric structure is permanently fixed, the cut-edge area is usable without difficulty, without the retraction of fibers or curling up of the edges.

This fixing also has some advantages even when used only as pre-fixing. One advantage is the improved leveling during the dying that follows later. The pilling tendency during dying and the dye consumption are reduced. Naturally, the formation of creases during subsequent bleaching or dying is also reduced, which also applies to the twisting effect of fabrics with Elasthan due to systematic curl formation.

It is also important that this steam-air mixture contacts the fiber without delay. The normal flow-through effect in rotary screens is especially suited for this. The use of a rotary screen behind a spreader for the shrinking of tubular fabric is known from DE-A-19 36 111, but also for drying from the above DE-A-16 35 348. The present invention, however, recommends keeping a specially spread out tubular fabric under a stream atmosphere essentially unchanged by way of induced suction, thereby also fixing the fiber.

One or several spreaders for the tubular fabric are arranged outside the heating unit, and the discharge end of the spreader extends into the heating unit, in which the width of the tubular fabric is retained. The discharge end of the spreader should thus be immediately allocated to a first rotary screen, preferably tangentially.

BRIEF DESCRIPTION OF THE DRAWINGS

An example of the device according to the invention is illustrated in the drawing. The FIGURE shows a longitudinal section through a customary rotary screen construction with two rotary screens and two spreaders which are allocated to the first rotary screen and are stacked on top of each other.

DETAILED DESCRIPTION OF THE INVENTION

A rotary screen unit basically consists of one more or less rectangular heat insulated housing 1, which is subdivided by a intermediate wall, which is not shown in this section, into a treatment space 2 and a fan space.

In space 2, there are two rotary screens 3, 3', and concentrically to each of these is one fan with a rotatable mount. When using two rotary screens, a good flow through the textile fabric can be maintained from both sides. The fan keeps the interior of the screens 3, 3' under induced suction. Heaters are located on top and at the bottom of the fan, which are made up from tubes through which the heating medium flows. In the treatment space 2, baffles 4 are located on top and below the rotary screens 3, 3', which provide the ram effect and thus provide an equal distribution of the air which flows from the fan ahead of the rotary screens 3, 3' over the entire working width. Each of the rotary screens is shielded against the induced suction on the inside of the area that is not covered by the textile fabric 5 with an inside cover 6, which is held in place on the axle.

The tubular fabric 5 is intended to be fixed within the prescribed dimensions in the rotary screen by the spreaders 7, 8. For this purpose, two spreaders 7, 8 are arranged in the first rotary screen 3, which extends upwards in such a way that the discharge end 9 is tangentially aligned towards the top of rotary screen 3. Both spreaders 7, 8, are stacked on top of each other outside of the rotary screen unit 1. Thus, the elements 10 that are required for changing the width adjustment are accessible from outside, and two tubes 5 can be fed to the rotary screen stacked on top of each other and treated there. Depending upon the working width of unit 1, several spreaders 7, 8 can also be arranged next to each other.

The treatment air can be heated up to the required temperature with the heaters, which are not shown in this section. For the fixing of the tubular fabric, a temperature of 180–230° C. is needed, preferably 210° C. To prevent damaging the cotton fiber or melting the Elasthan fiber at this temperature, the fixing process is carried out with an appropriately heated steam-air mixture. For this purpose, superheated steam is injected into the treatment space 3. This fact is indicated by the arrows 11. The steam can be introduced either in the fan space, or at another suitable location. The generated steam-air mixture prevents damage to the fibers even at this elevated fixing temperature. Moreover, the treatment on the rotary screen acts rapidly, producing the required effect within a short period.

What is claimed is:

1. Method for fixing of tubular fabric, comprising:

deliberately spreading the tubular fabric at ambient temperature, and, immediately after discharge from the spreader, heat treating the tubular fabric at a temperature of 110–250° C. using a steam-air mixture.

2. Method according to claim 1, characterized in that the temperature of the steam-air mixture is kept between 160 and 230° C.

3. Method according to claim 1, characterized in that the steam-air mixture for fixing is directed diagonally through the tube.

4. Method according to claim 3, characterized in that, during the heat treating, tubular fabric is held spread open and transported by a rotary screen which is under induced suction.

5. Method according to claim 4, characterized in that the steam-air mixture alternatively flows through the tubular fabric from each side of the tubular fabric.

6. Method according to claim 1, characterized in that the tubular fabric comprises cotton and elastic fibers.

7. Method according to claim 1, characterized in that the spreading of the tubular fabric is carried out without marking edges of the fabric.

8. Method according to claim 1, characterized in that the temperature of the steam-air mixture is kept between 180 and 220° C.

* * * * *